US010121581B2

(12) United States Patent
Zhu et al.

(10) Patent No.: US 10,121,581 B2
(45) Date of Patent: Nov. 6, 2018

(54) METHOD FOR MAGNETIZING MULTIPLE ZONES IN A MONOLITHIC PIECE OF MAGNETIC MATERIAL

(71) Applicant: Apple Inc., Cupertino, CA (US)

(72) Inventors: Hao Zhu, San Jose, CA (US); John C. DiFonzo, Emerald Hills, CA (US); Sean S. Corbin, San Jose, CA (US)

(73) Assignee: Apple Inc., Cupertino, CA (US)

( * ) Notice: Subject to any disclaimer, the term of this patent is extended or adjusted under 35 U.S.C. 154(b) by 412 days.

(21) Appl. No.: 14/500,887

(22) Filed: Sep. 29, 2014

(65) Prior Publication Data

US 2016/0093424 A1 Mar. 31, 2016

(51) Int. Cl.
*H01F 13/00* (2006.01)

(52) U.S. Cl.
CPC ..... *H01F 13/003* (2013.01)

(58) Field of Classification Search
CPC ..... H01F 13/003
See application file for complete search history.

(56) References Cited

U.S. PATENT DOCUMENTS 5,956,295 A * 9/1999 Yamakawa ..... G11B 7/126 369/116
6,377,414 B1 * 4/2002 Wang ..... B82Y 10/00 360/131
6,711,102 B1 * 3/2004 Murakami ..... G11B 5/41 369/13.36
7,015,780 B2 * 3/2006 Bernstein ..... G02B 26/0841 335/285
7,207,102 B1 * 4/2007 Roesler ..... H01F 13/003 148/101
9,224,529 B2 * 12/2015 Gery ..... H01F 13/003
2005/0145302 A1 * 7/2005 Mutterer ..... G01D 5/145 148/108
2006/0238286 A1 10/2006 Henn et al.
2008/0043518 A1 2/2008 Schumacher
2008/0169892 A1 7/2008 Komura et al.
2011/0074231 A1 3/2011 Soderberg
2013/0135071 A1 5/2013 Roberts et al.

OTHER PUBLICATIONS

Floppy Specs. FujiFilm. SSFD003 https://www.fujifilmusa.com/shared/bin/floppyspecs.pdf. Published 1999. Retrieved on Nov. 9, 2016.*
PCT Application No. PCT/US2015/015678—International Search Report and Written Opinion dated Jul. 13, 2015.

* cited by examiner

*Primary Examiner* — Matthew E. Hoban
(74) *Attorney, Agent, or Firm* — Dickinson Wright RLLP

(57) ABSTRACT

An article having a multiple magnetic polarities and a method for making the article are disclosed. The article can be a monolithic substrate form from a metallic material or materials. The article may include a first magnetic polarity and a second magnetic polarity opposite the first magnetic polarity. Methods for making the article include provide either providing a monolithic substrate having a first magnetic polarity, or applying a first magnetic field to the monolithic substrate to impart a first magnetic polarity. The method may also include raising the temperature of the monolithic substrate in order to reduce the coercivity of the monolithic substrate. The temperature of the monolithic substrate may also be selectively raised to lower the coercivity of the monolithic substrate in associated areas. By lowering the coercivity, the second magnetic polarity may be imparted on the monolithic substrate.

20 Claims, 9 Drawing Sheets

*PRIOR ART*

METHOD FOR MAGNETIZING MULTIPLE ZONES IN A MONOLITHIC PIECE OF MAGNETIC MATERIAL

FIELD

The described embodiments relate generally to forming a magnet. In particular, the present embodiments relate to forming a multi-pole magnet from a monolithic substrate.

BACKGROUND

Some devices include a magnetic assembly having more than one magnetic polarity. This can be done in several ways. Several individual magnets with different polarities can be aligned together to form the magnetic assembly. Alternatively, an electromagnet may be used to apply a magnetic field to a substrate.

However, each method has drawbacks. For instance, aligning several magnets can be time consuming and expensive. Further, to cut the magnets made from relatively hard materials requires a high end blade (e.g., diamond blade) which erodes much of the substrate during the cutting process. Electromagnets may require a relatively high amount of voltage and current, particularly in materials having a high coercivity. This may also increase costs and create a potentially dangerous environment.

SUMMARY

In one aspect, a method for forming a magnet having magnetic field lines in multiple directions from a substrate is described. The method may include applying a first magnetic field to the substrate to impart a magnetic polarity in a first direction to the substrate. The method may include heating the substrate. In some embodiments, the substrate includes a first portion and a second portion. In these embodiments, the first portion and the second portion may include a first coercivity prior to heating the substrate. The method may further include applying a second magnetic field to the substrate to impart a magnetic polarity in a second direction to the substrate. In some embodiments, the second direction is opposite the first direction.

In another aspect, a method for forming a multi-polarity magnet from a substrate is described. The method may include applying a first magnetic field in a first direction to a first portion of the substrate. The method may further include applying a second magnetic field in a second direction to a second portion of the substrate. In some embodiments, the second direction is opposite the first direction. The method may further include means for changing the substrate from a first coercivity to a second coercivity different from the first coercivity.

In another aspect, a monolithic substrate is described. The monolithic substrate may include a first portion having a magnetic field in a first direction. The monolithic substrate may further include a second portion having a magnetic field in a second direction opposite the first direction. The monolithic substrate may further include a third portion having the magnetic field in the first direction. The monolithic substrate may further include a fourth portion having the magnetic field in the second direction. In some embodiments, the second portion is positioned between the first portion and the third portion. In some embodiments, the third portion is positioned between the second portion and the fourth portion.

Other systems, methods, features and advantages of the embodiments will be, or will become, apparent to one of ordinary skill in the art upon examination of the following figures and detailed description. It is intended that all such additional systems, methods, features and advantages be included within this description and this summary, be within the scope of the embodiments, and be protected by the following claims.

BRIEF DESCRIPTION OF THE DRAWINGS

The disclosure will be readily understood by the following detailed description in conjunction with the accompanying drawings, wherein like reference numerals designate like structural elements, and in which.

Figure 1:
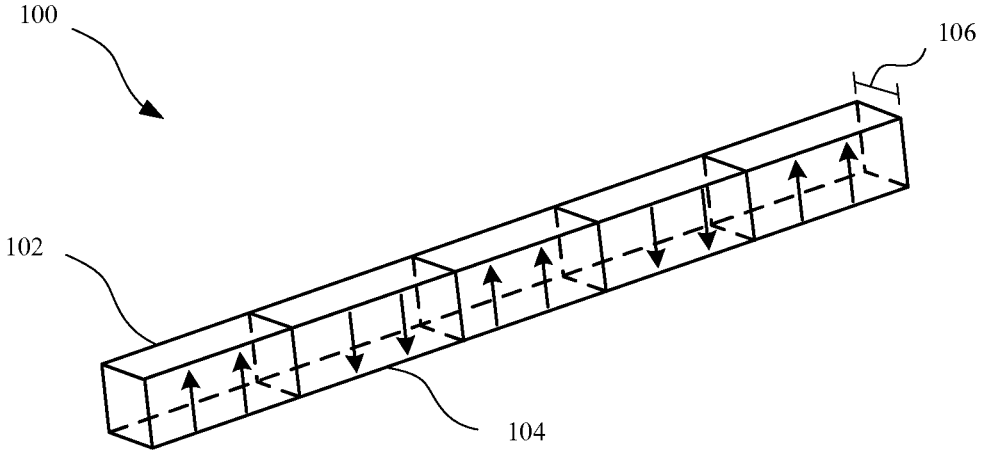
FIG. 1 PRIOR ART
FIG. 1 illustrates a magnetic assembly having several magnets arranged in a row.

Those skilled in the art will appreciate and understand that, according to common practice, various features of the drawings discussed below are not necessarily drawn to scale, and that dimensions of various features and elements of the drawings may be expanded or reduced to more clearly illustrate the embodiments of the present invention described herein.

DETAILED DESCRIPTION

Reference will now be made in detail to representative embodiments illustrated in the accompanying drawings. It should be understood that the following descriptions are not intended to limit the embodiments to one preferred embodiment. To the contrary, it is intended to cover alternatives, modifications, and equivalents as can be included within the spirit and scope of the described embodiments as defined by the appended claims.

In the following detailed description, references are made to the accompanying drawings, which form a part of the description and in which are shown, by way of illustration, specific embodiments in accordance with the described embodiments. Although these embodiments are described in sufficient detail to enable one skilled in the art to practice the described embodiments, it is understood that these examples are not limiting such that other embodiments may be used, and changes may be made without departing from the spirit and scope of the described embodiments.

The following disclosure relates to a monolithic substrate having portion with magnetic field lines in different directions. The monolithic substrate may be a single piece of metal having magnetic field lines in a first direction and magnetic field lines in a second direction opposite the first direction. For example, the monolithic substrate includes an orientation of a north-seeking pole, or "north" pole, and a south-seeking pole, or "south" pole, to define a magnetic field in a first direction. The monolithic substrate also includes another orientation of a north pole and a south to define a magnetic field in a second (opposite) direction. To impart or impose the magnetic field in the second direction to the monolithic substrate, the coercivity of the monolithic substrate may be altered. The term "coercivity" as used throughout this detailed description and in the claims refers to a measure of the ability of a ferromagnetic material to withstand or resist becoming demagnetized by an external magnetic field. Coercivity may also be associated with the intensity of an external magnetic field required to reduce the magnetization of a material to zero. For instance, a material with a relatively low coercivity requires a relatively low external magnetic field to reduce the magnetic field to zero. Further, once the magnetic field of a monolithic substrate is reduced to zero, the external magnetic field may reverse the magnetic field of the monolithic substrate such that the monolithic substrate including a region initially having a magnetic field in a first direction to now including a magnetic field in a second direction.

Generally, the coercivity is inversely proportional with respect to temperature. In other words, the coercivity may be decreased by increasing the temperature of the monolithic substrate (e.g., heating). Alternatively, the coercivity may be increased by decreasing the temperature of the monolithic substrate. While the temperature of the entire monolithic substrate can be altered, in some cases, localized temperature changes can be performed. Altering means may include placing the monolithic substrate in an oven to heat the monolithic, or positioning a magnet having a temperature different from the monolithic substrate proximate to the monolithic substrate. For instance, the magnet may include a temperature lower than that of the monolithic substrate.

Lowering the coercivity of the monolithic substrate has several advantages. For example, an external magnetic field required to change the magnetic polarity of the substrate may be relatively low in instances where the coercivity is sufficiently decreased. This may save energy costs in cases where an electromagnet requiring electrical current is used to create the external magnetic field.

These and other embodiments are discussed below with reference to FIGS. 3-14. However, those skilled in the art will readily appreciate that the detailed description given herein with respect to these Figures is for explanatory purposes only and should not be construed as limiting.

FIG. 1 illustrates an embodiment of magnetic assembly 100 having several magnets arranged in a row. Magnetic assembly 100 may include first magnet 102 and second magnet 104 adjacent to first magnet 102. First magnet 102 may include a first polarity, that is, first magnet 104 is magnetized in a first direction. Second magnet 104 may include a second polarity opposite the first polarity, or magnetized in a second direction opposite the first direction. The direction of magnetization is denoted by the arrows.

Aligning magnetic assembly 100 in this manner can be time consuming and expensive. Also, in cases where magnetic assembly 100 includes magnets formed from relatively dense materials (e.g., neodymium, samarium cobalt), the magnets must be cut by a robust cutting tool, such as a diamond saw, to cut the individual magnets. Further, in cases where magnetic assembly 100 includes a dimension 106 on the order of a few millimeters, a relatively large portion of the material is lost due to the cutting action of the diamond saw. This results in wasted material.

Figure 2:
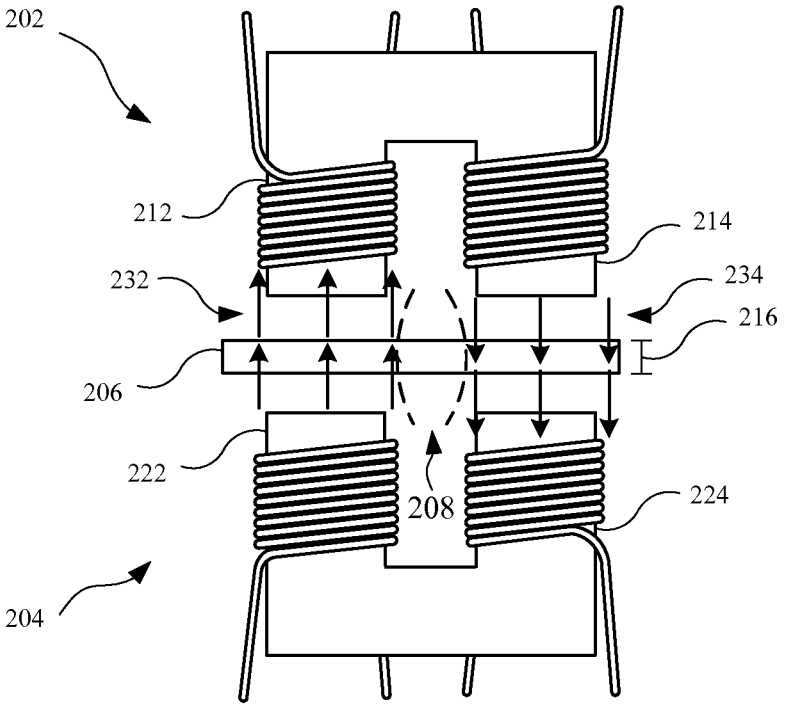
FIG. 2 illustrates a first electromagnet and a second electromagnet used simultaneously to form a substrate into a magnet.

FIG. 2 illustrates a plan view of first electromagnet 202 and second electromagnet 204 used simultaneously to form substrate 206 into a magnet. Both first electromagnet 202 and second electromagnet 204 may combine to form an electromagnetic field in opposite directions. In this manner, substrate 206 may be formed having magnetized regions with opposite magnetic polarities. However, substrate 206 formed in this manner also includes non-magnetized region 208 resulting from the prongs in close proximity to one another and having opposing electromagnetic fields. For instances, first electromagnetic 202 having first prong 212 and second prong 214 is paired with second electromagnet 204 having third prong 222 and fourth prong 224 to form first magnetic polarity 232 and second magnetic polarity 234. As shown, first prong 212 and third prong 222 combine to impart first magnetic polarity 232 while second prong 214 and fourth prong 224 combine to impart second magnetic polarity 234 on substrate 206. Non-magnetized region 208 is the result of the competing polarities offsetting each other due to the proximity of the prongs. Accordingly, substrate 206 includes a region in which substrate includes no magnetic polarity and accordingly cannot attract ferrous materials. This is undesirable, particularly when substrate 206 includes a dimension 216 on the order of a few millimeters or less, as non-magnetized region 208 may occupy a larger portion of substrate 206.

Smaller electromagnets require an increasing amount of current, in some cases on the order of several thousand Amps, to attempt to reduce non-magnetized region 208. Moreover, the thickness of the wire used to form the coils of the electromagnets may be too large to both support the increased current and fit around relatively small prongs.

Figure 3:
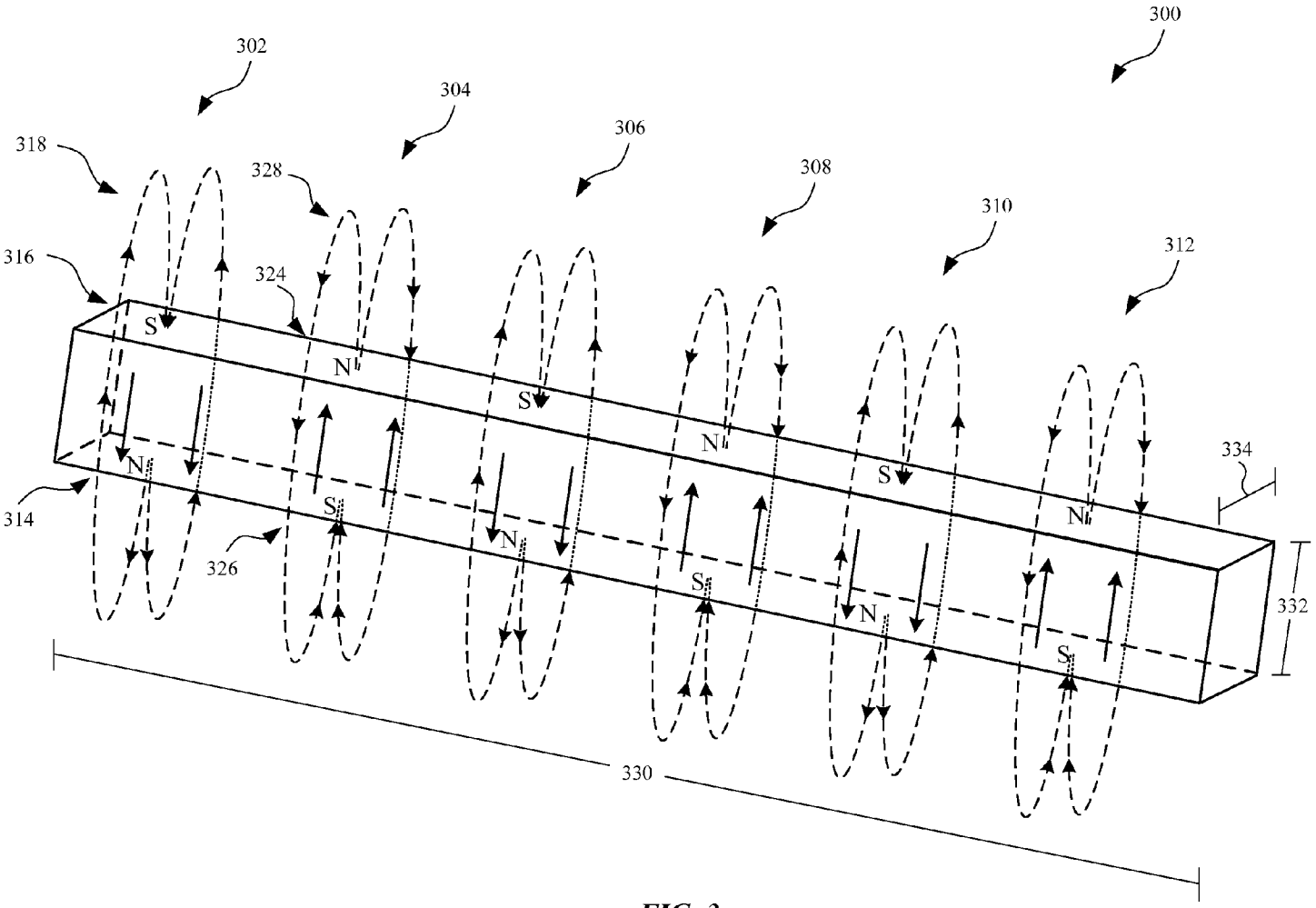
FIG. 3 illustrates an isometric view of a substrate having multiple portions, with each portion having a dipole magnetic arrangement and associated magnetic field lines, in accordance with the described embodiments.

FIG. 3 illustrates an isometric view of substrate 300 having multiple portions, with each portion having a dipole magnetic arrangement and associated magnetic field lines, in accordance with the described embodiments. For example, substrate 300 may include first portion 302 and second portion 304 adjacent to first portion 302. As shown, first portion 302 and second portion 304 are designed to include magnetic fields extending in opposite directions. For example, first portion 302 may include a dipole magnetic arrangement having first pole 314 (e.g., north-seeking pole, or "north" pole) and second pole 316 opposite first pole (e.g., south-seeking pole, or "south" pole) resulting in magnetic field lines in a first direction 318. Second portion 304 may also include a dipole magnetic arrangement having first pole 324 (similar to first pole 314) and second pole 326 (similar to second pole 316) opposite first pole 324. However, second portion 304 includes first pole 324 and second pole 326 are arranged to form magnetic field lines in a second direction 328 opposite first direction 318. This may be performed by switching the locations or regions of first pole 324 and second pole 326 of second portion 304, as compared to first pole 314 and second pole 316, respectively, of first portion 302.

Substrate 300 may further include third portion 306 and fourth portion 308 having substantially similar dipole magnetic arrangements as those of first portion 302 and second portion 304, respectively. Substrate 300 may include this arrangement along a lengthwise direction 330 of substrate 300 such that fifth portion 310 and sixth portion 312 are substantially similar to that of first portion 302 and second portion 304, respectively. In other embodiments, substrate 300 includes several additional portions similar to those of first portion 302 and second portion 304. Also, in some embodiments, substrate 300 is a monolithic substrate. Substrate 300 may generally be formed from any hard ferromagnetic material. Also, substrate 300 may include first dimension 332 and second dimension 334, and accordingly, substrate 300 may be magnetized in multiple dimensions (e.g., two dimensions) described in the magnetization methods herein. Both first dimension 332 and second dimension 334 may be approximately in the range of 0.4 to 2.2 millimeters.

Figure 4:
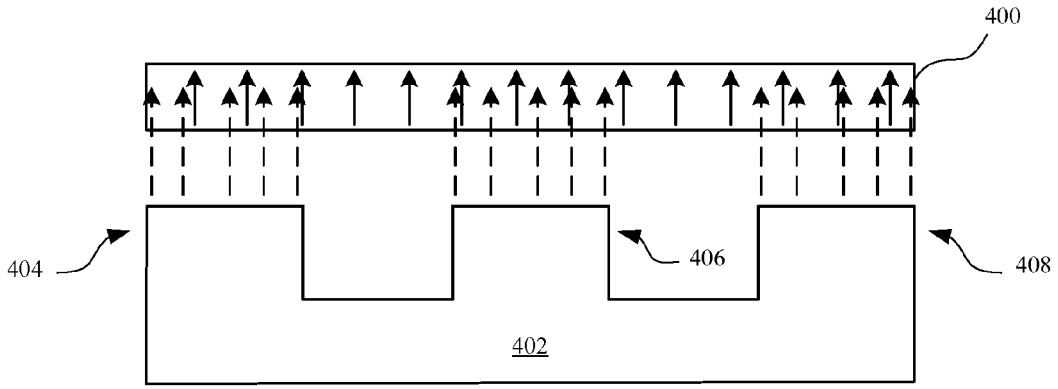
FIG. 4 illustrates a plan view of an embodiment of a substrate formed from a ferrous or ferromagnetic material, in accordance with the described embodiments.

FIGS. 4-7 illustrate a process for transforming a substrate (e.g., substrate 300) into a magnet having several dipole magnetic arrangements, in accordance with the described embodiments. FIG. 4 illustrates a plan view of substrate 400 formed from a magnetic material, in accordance with the described embodiments. As shown, substrate 400 is a monolithic substrate. Fixture 402 may be used to apply an external magnetic field or magnetic flux lines (shown as dotted lines) to substrate 400. The magnetic field may include a strength of approximately 30 kG (kilogauss). In some embodiments, fixture 402 is made from iron, which may include a soft iron. When a magnetic field (not shown) is applied to fixture 402, magnetic fields may be concentrated at extensions of fixture 402, such as first extension 404, second extension 406, and third extension 408. Fixture 402 is capable of producing magnetic flux lines at the extensions of fixture 402 in order to transform substrate 400 into a magnet having magnetic flux lines in a first direction, as shown in the arrows within substrate 400. Although FIG. 4 shows substrate 400 transforming into a magnet, in other embodiments, the process may alternatively include substrate 400 already transformed into a magnet with magnetic flux lines similar to those shown in FIG. 4.

Figure 5:
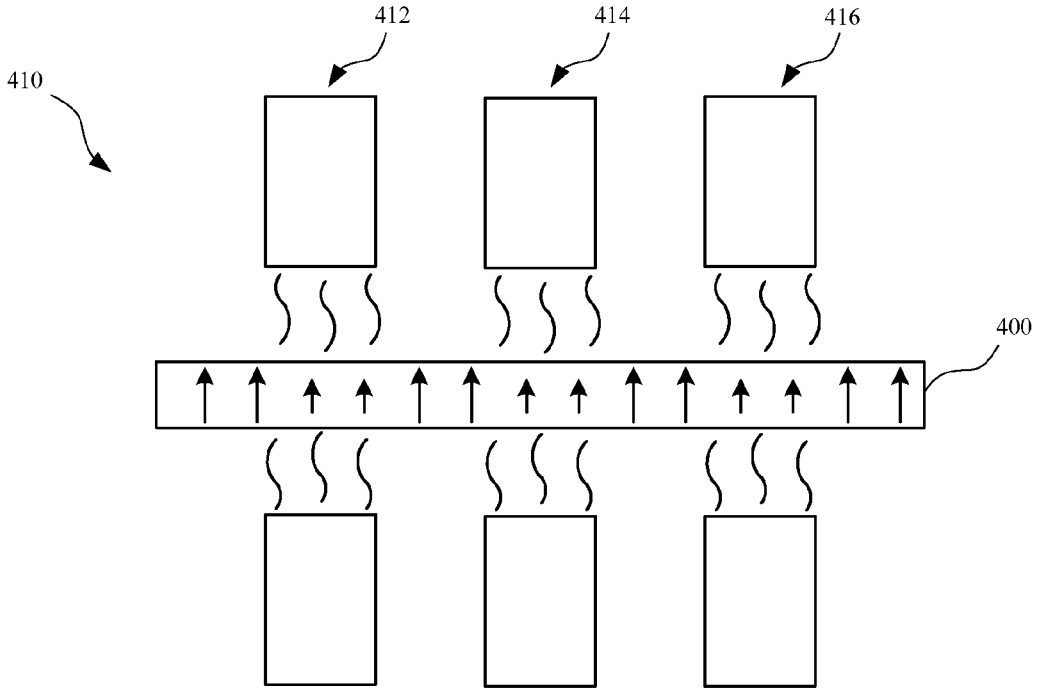
FIG. 5 illustrates a plan view of a substrate shown in FIG. 4, positioned within a heating element.

FIG. 5 illustrates a plan view of substrate 400 shown in FIG. 4, positioned within heating element 410 emitting heat (denoted by the wavelike lines). Heating element 410 may generally be any type of heating instrument capable of producing localized heating to raise substrate 400 from a room temperature to at least 150 degrees Celsius. This may include a laser heating device or an inductive heating device. Heating element 410 may include multiple heating elements, such as first heating element 412, second heating element 414, and third heating element 416, designed and positioned to provide localized heating to substrate 400. In this manner, in these regions of localized heating, substrate 400 initially having a first coercivity may decrease to a second coercivity (denoted as relatively smaller arrows) less than the first coercivity. That is, in the regions of localized heating, the ability of substrate 400 to resist a change (e.g., decrease) in magnetization is reduced.

Figure 6:
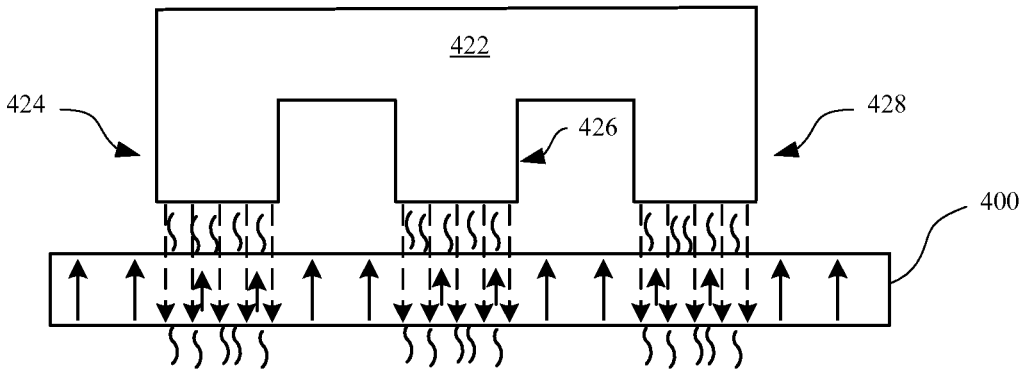
FIG. 6 illustrates a plan view of a substrate shown in FIG. 5, with a fixture applying a magnetic field or magnetic flux lines in a direction opposite of those produced from a fixture shown in FIG. 4.
Figure 7:
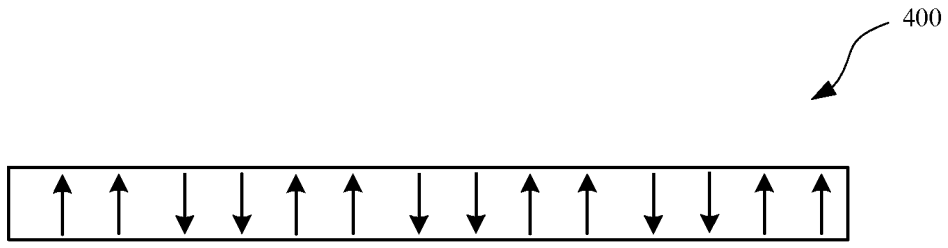
FIG. 7 illustrates an embodiment of a monolithic substrate having several portions portions in which adjacent portions include magnetic field lines are aligned in opposite directions, in accordance with the described embodiments.

When substrate 400 includes a second (lesser) coercivity, a magnetic field having magnetic flux lines in the opposite direction as those of substrate 400 may be applied to substrate 400 to not only (momentarily) demagnetize substrate 400 but to also magnetize substrate 400 to include a magnetic field in a different direction. For example, FIG. 6 illustrates a plan view of substrate 400 shown in FIG. 5, with fixture 422 applying a magnetic field (shown as dotted lines) to substrate 400 in a direction opposite of those produced from fixture 402 (shown in FIG. 4). Fixture 422 may be made from any material or materials used to make a fixture previously described. When a magnetic field (not shown) is applied to fixture 422, magnetic fields may be concentrated at extensions of fixture 422, such as first extension 424, second extension 426, and third extension 428. Also, fixture 422 is designed and positioned in a manner such that first extensions of fixture 422, such as first extension 424, second extension 426, and third extension 428 are proximate to the regions of localized heating of substrate 400. Further, fixture 422 is capable of producing magnetic flux lines at the extensions of fixture 422 in order to transform substrate 400 into a magnet having magnetic field lines in a second direction in the regions of localized heating. In this manner, substrate 400 may include multiple portions in which adjacent portions include magnetic field lines that are aligned in opposite directions, as shown in FIG. 7.

Referring again to FIG. 6, fixture 422 can be configured to produce magnetic flux lines strong enough to alter the magnetization (e.g., direction of magnetic field lines) in areas of substrate 400 having a second coercivity. Generally, the regions associated with the second coercivity are also associated with the regions of localized heating. Further, these magnetic flux lines produced by fixture 422 may be of a magnetic strength (e.g., 5 kilogauss) incapable of altering substrate 400 in regions of substrate 400 having a first coercivity greater than the second coercivity. These may also be referred to as the regions not heated by heating element 410 (in FIG. 5). Accordingly, fixture 422 may be designed to affect portions having a particular coercivity (e.g., second coercivity) so as ensure substrate 400 includes adjacent portions having magnetic field lines in opposite directions. Also, non-magnetic regions, if any, between adjacent portions are generally negligible.

Figure 8:
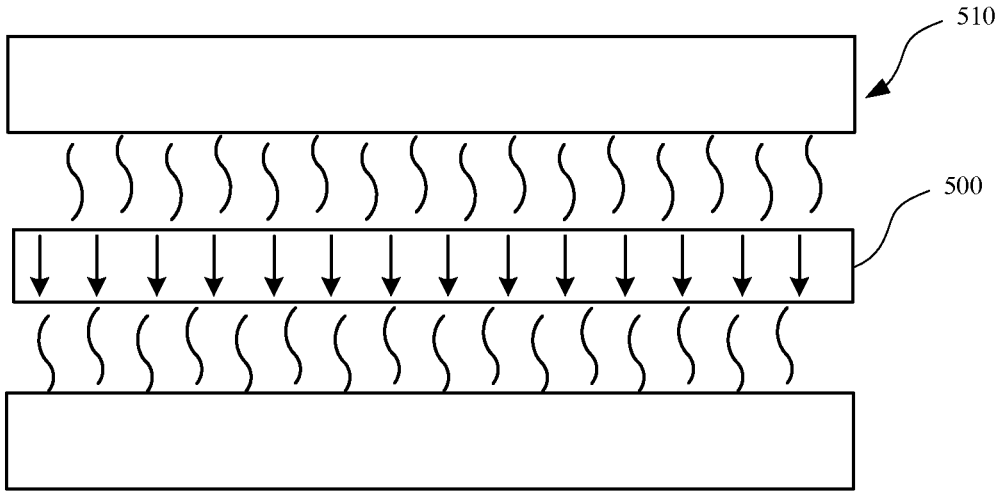
FIG. 8 illustrates a plan view of an embodiment of a substrate formed from a ferrous or ferromagnetic material, in accordance with the described embodiments.

FIGS. 8-11 illustrate another process for transforming a substrate (e.g., substrate 300) into a magnet having several dipole magnetic arrangements, in accordance with the described embodiments. FIG. 8 illustrates a plan view of an embodiment of substrate 500 formed from a ferrous or ferromagnetic material, in accordance with the described embodiments. As shown, substrate 500 is a monolithic substrate. In some embodiments, a magnetic field (not shown) may be applied to substrate 500 to transform substrate into a magnet with magnetic field lines, denoted as arrows, aligned in a first direction. Substrate 500 may be positioned within heating element 510 in order to raise the temperature of substrate 500. In some embodiments, heating element 510 is an oven designed to raise the temperature of substrate 500 from a first temperature (e.g., ambient temperature) to at least 150 degrees Celsius. Unlike previous embodiments, in the embodiment shown in FIG. 8, substrate 500 is generally heated in its entirety to a temperature such that the coercivity of substrate 500 decreases from a first coercivity to a second coercivity.

Figure 9:
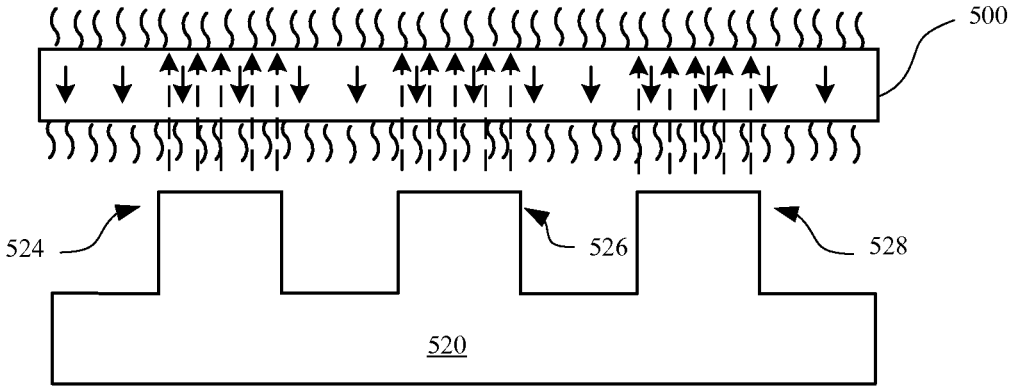
FIG. 9 illustrates the embodiment of the substrate shown in FIG. 8, heated to a temperature such that the substrate includes a second, lower coercivity and positioned proximate to a fixture.

FIG. 9 illustrates the embodiment of substrate 500 shown in FIG. 8, heated to a temperature such that substrate 500 includes a second, lower coercivity (denoted as relatively smaller arrows) and positioned proximate to fixture 520 designed to provide localized magnetic field lines. Fixture 520 may be made from any material previously described for a fixture. In FIG. 9, fixture 520 is configured to apply a magnetic field (shown as dotted lines) in a second direction opposite of the magnetic field of substrate 500. When a magnetic field (not shown) is applied to fixture 520, magnetic fields (shown as dotted lines) may be concentrated at extensions of fixture 520, such as first extension 524, second extension 526, and third extension 528. In this manner, fixture 520 may produce magnetic fields such that portions of substrate 500 within the magnetic field lines of fixture change from having magnetic field lines from a first direction to a second direction opposite the first direction, similar to that of substrate 400 (shown in FIG. 7).

Figure 10:
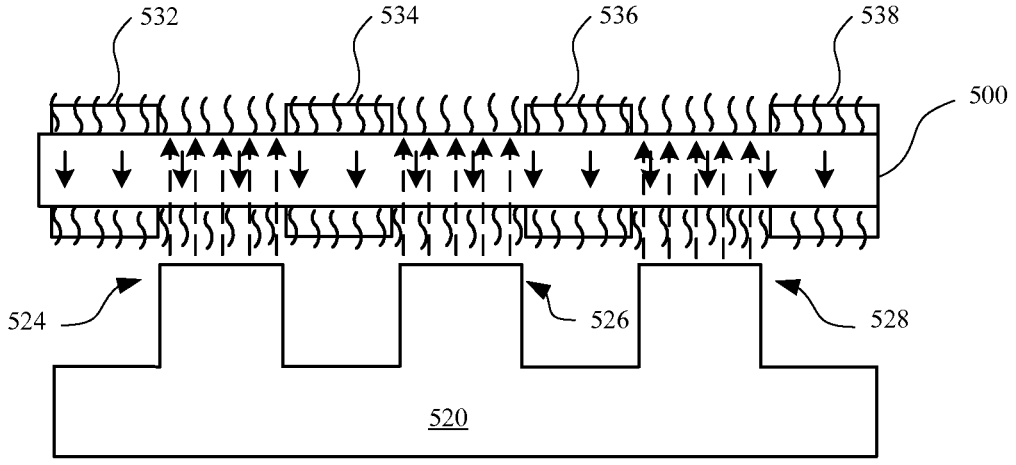
FIG. 10 illustrates a plan view of a substrate having several magnetic shunts proximate to the substrate, in accordance with the described embodiments.

In order to ensure substrate 500 is formed with desired magnetic properties, that is, with adjacent portion having magnetic fields aligned in opposite directions, additional techniques may be used. For example, FIG. 10 illustrates a plan view of substrate 500 having several magnetic shunts 530 proximate to substrate 500, in accordance with the described embodiments. In some embodiments, magnetic shunts 530 may be engaged with substrate 500. As shown in FIG. 10, magnetic shunts 530 may include first magnetic shunt 532, second magnetic shunt 534, third magnetic shunt 536, and fourth magnetic shunt 538. Magnetic shunts 530 may be made from metallic materials such as iron, including a soft iron. Generally, magnetic shunts 530 include properties such as a relatively high magnetic permeability. In this manner, magnetic shunts 530 may be arranged in locations along substrate 500 in order to maintain the direction of magnetic field lines of substrate 500 in those locations. For example, magnetic shunts 530 in FIG. 10 are positioned in locations to maintain magnetic fields in a first direction, while fixture 520 is positioned proximate to locations of substrate 500 in order change the magnetic fields from a first direction to a second direction opposite the first direction. Any magnetic fields (shown as dotted lines) received in location of substrate 500 proximate to magnetic shunts 530 may be absorbed by the magnetic shunts 530 so as not to disturb the magnetic field direction in of substrate 500 in those locations. Magnetic shunts 530 used in this manner provide a means for maintaining desired magnetic field lines even when the coercivity of substrate 500 is reduced when heating substrate 500.

Figure 11:
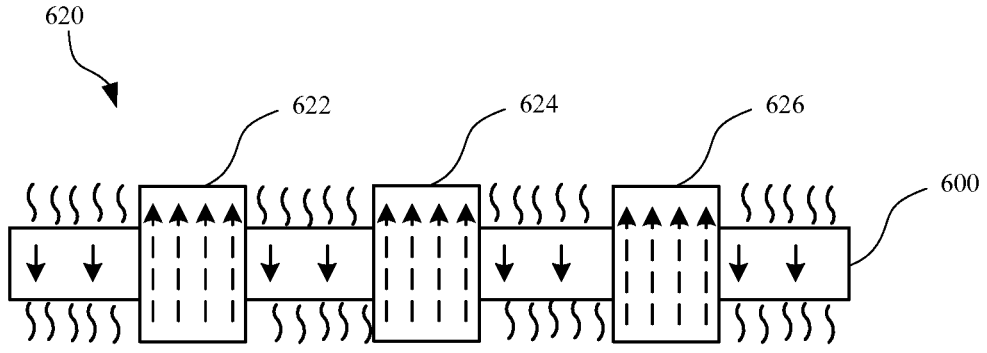
FIG. 11 illustrates a plan view of a substrate having magnetic field lines aligned in a first direction proximate to a magnet assembly having magnetic field lines aligned in a second direction opposite the first direction.

When the coercivity is substantially reduced, a fixture previously described may not be required to change the direction of the magnetic field. For example, FIG. 11 illustrates a plan view of substrate 600 having magnetic field lines (shown as arrows within substrate 600) aligned in a first direction proximate to magnet assembly 620 having magnetic field lines in a second direction (denoted as arrows with dotted lines) opposite the first direction. In some embodiments, magnet assembly 620 includes permanent magnets. In some embodiments, magnet assembly 620 includes neodymium magnets. As shown, magnet assembly 620 includes first magnet 622, second magnet 624, and third magnet 626. Each of first magnet 622, second magnet 624, and third magnet 626 may include a magnetic field strength capable of altering substrate 600 to include magnetic field lines in a second direction, in locations proximate to first magnet 622, second magnet 624, and third magnet 626. In addition, magnet assembly 620 may include a temperature substantially less than that of substrate 600 when substrate 600 is heated, as the magnetization of substrate 600 is changed (for example, from first direction to a second direction) before a change in temperature (e.g., cooling of substrate 600) begins to alter coercivity, even when substrate 600 is relatively thin (e.g., having dimensions of 2 millimeters or less). This may allow manufacturing/processing times of substrate 600 to decrease as substrate 600 may be handled in a relatively shorter time due to the increased cooling from magnet assembly 620.

Also, although not shown, magnetic shunts may be positioned proximate to, or engaged with, substrate 600 in locations of substrate 600 that are not proximate to magnet assembly 620. This ensures substrate 600 is transformed into a magnet with desired magnetic field lines (that is, similar to those shown in FIGS. 3 and 7). Using permanent magnets may be an energy-saving alternative, particular when fixtures previously described require an electromagnet.

Although coercivity of a substrate previously described decreases with increasing temperature, the substrate may regain its initial, or first, coercivity when the temperature of the substrate decreases. This property allows the substrates previously described to maintain their desired magnetic properties.

Figure 12:
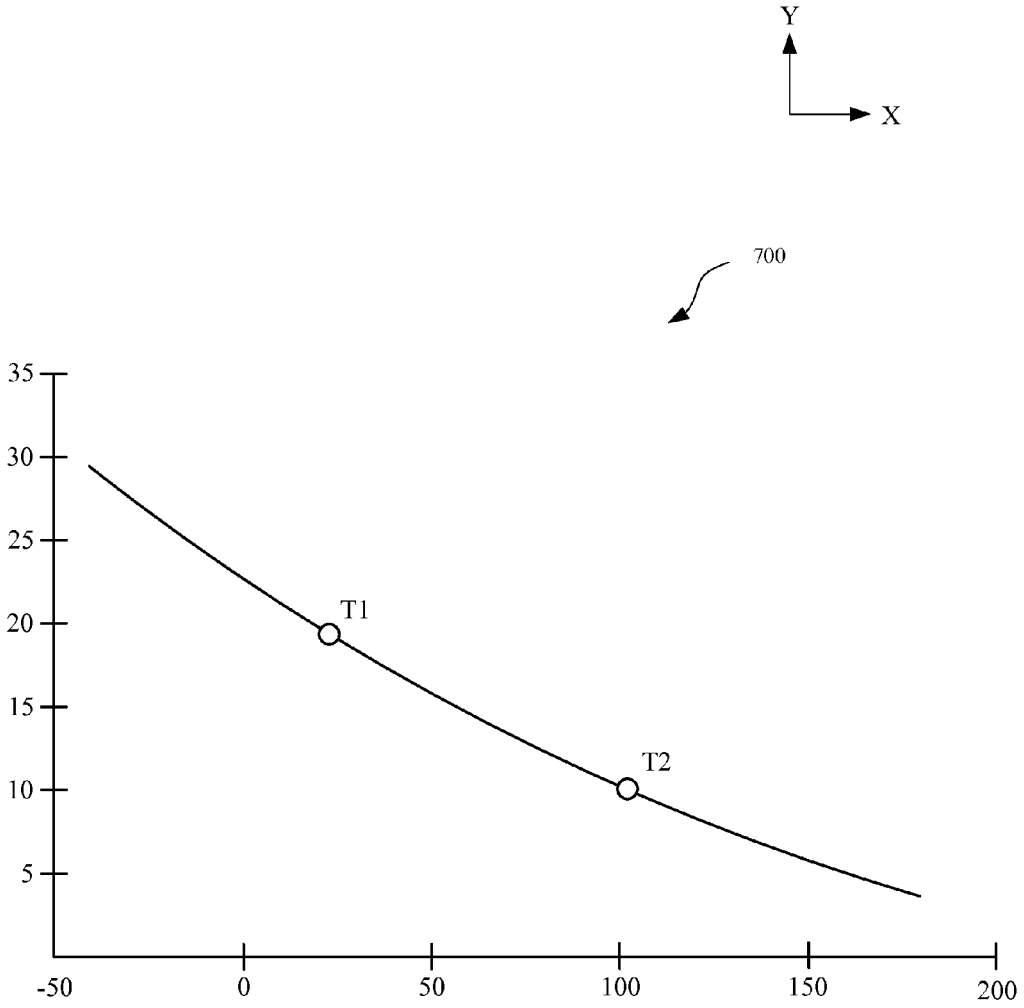
FIG. 12 illustrates an X-Y graph showing coercivity vs. temperature for a neodymium (N45SH) magnet.

FIG. 12 illustrates an X-Y graph 700 showing coercivity vs. temperature for a neodymium (N45SH) magnet. The substrates previously described may be made from neodymium magnet. Coercivity, shown on the y-axis, is in units of kilo-oersteds (KOe), and temperature, shown on the x-axis, is in units of degrees Celsius. The graph illustrates that neodymium magnet has a coercivity at temperature T1, approximately 20-25 degrees Celsius, that reduces by approximately 50% at temperature T2, approximately 100 degrees Celsius. These charts may be useful in determining where coercivity of a substrate is most sensitive to changes in temperature in order to influence the magnetic fields of the substrate along these temperatures of greatest sensitivity.

Figure 13:
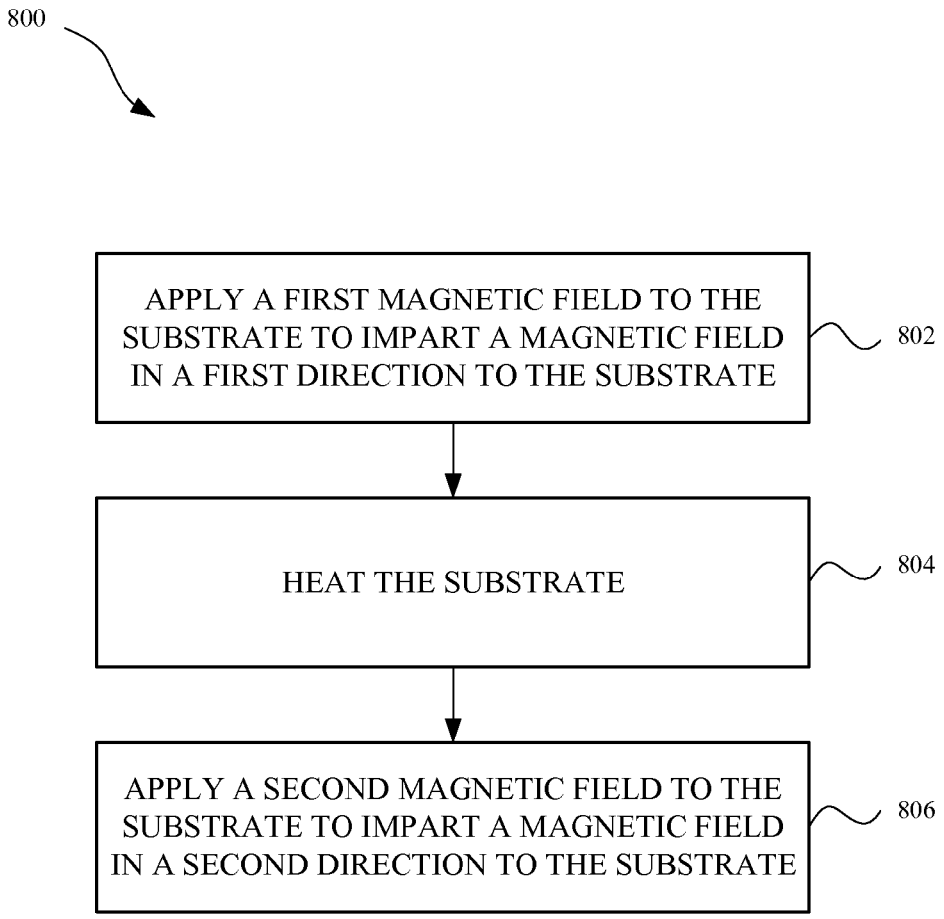
FIG. 13 illustrates a flowchart showing a method for forming a magnet having magnetic field lines in multiple directions from a substrate.

FIG. 13 illustrates a flowchart 800 showing a method for forming a magnet having magnetic field lines in multiple directions from a substrate. In step 802, a first magnetic field is applied to the substrate to impart a magnetic field in a first direction to the substrate. The term "first direction" may be associated with an orientation of a dipole arrangement of a north pole and a south pole. Also, the first magnetic field may be applied by a fixture that receives an external magnetic field. The fixture is configured to have concentrated magnetic flux lines along extensions of the fixture.

In step 804, the substrate is heated. Heating means may include localized heating (e.g., laser heating or inductive heating) to selectively heat the substrate. In other embodiments, heating means may include an oven used to heat the entire substrate. Also, the substrate may include a first portion and a second portion adjacent to the first portion. The first portion may be designed to include magnetic field lines orientated in a first direction, and the second portion may be designed to include magnetic field lines oriented in a second direction opposite the first direction. Also, the substrate may initially include a first coercivity before the substrate is heated. However, when the substrate is heated from an initial, or first, temperature to a second temperature greater than the first temperature, the heated portions of the substrate may decrease to a second coercivity less than the first coercivity.

In step 806, a second magnetic field to the substrate to impart a magnetic field in a second direction to the substrate. In some embodiments, the second direction is a direction opposite the first direction. In other words, the north pole and the south pole are arranged in the second direction are opposite the locations relative to the first direction.

Also, a magnetic shunt may be used, particularly when the substrate includes magnetic field lines already oriented in a desired direction, that is, in a direction that is not intended to change (to the second direction).

Figure 14:
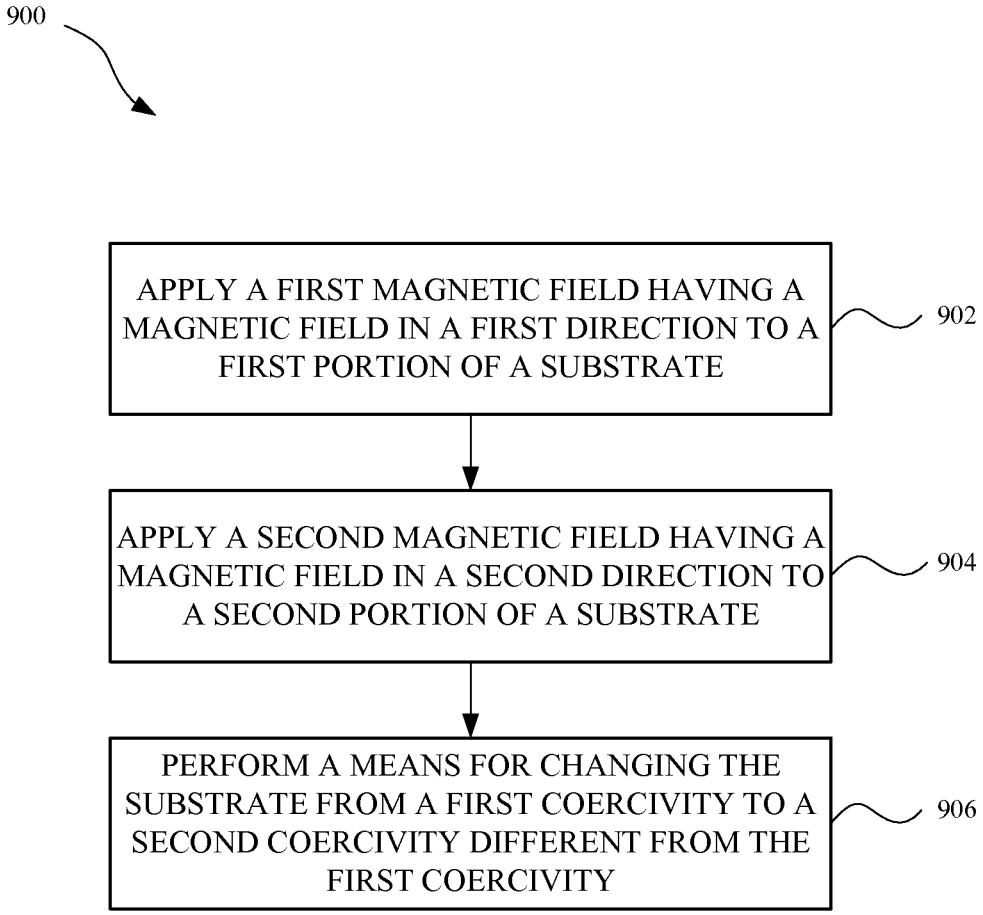
FIG. 14 illustrates a flowchart showing a method for forming a multi-polarity magnet from a substrate.

FIG. 14 illustrates a flowchart 900 showing a method for forming a multi-polarity magnet from a substrate. In step 902, a first magnetic field having a magnetic field in a first direction to a first portion of a substrate. In step 904, applying a second magnetic field having a magnetic field in a second direction to a second portion of a substrate. The second direction is opposite the first direction. In step 906, means for changing the substrate from a first coercivity to a second coercivity different from the first coercivity is performed. Means for change the coercivity include heating the substrate, either locally or the entire substrate, or positioning a magnet proximate to the substrate. The magnet can include a lower temperature than that of the substrate. The substrates described in this and in other embodiments may include dimensions as small as approximately 2 millimeters, and in some cases, as small as approximately 0.5 millimeters.

The various aspects, embodiments, implementations or features of the described embodiments can be used separately or in any combination. Various aspects of the described embodiments can be implemented by software, hardware or a combination of hardware and software. The described embodiments can also be embodied as computer readable code on a computer readable medium for controlling manufacturing operations or as computer readable code on a computer readable medium for controlling a manufacturing line. The computer readable medium is any data storage device that can store data which can thereafter be read by a computer system. Examples of the computer readable medium include read-only memory, random-access memory, CD-ROMs, HDDs, DVDs, magnetic tape, and optical data storage devices. The computer readable medium can also be distributed over network-coupled computer systems so that the computer readable code is stored and executed in a distributed fashion.

The foregoing description, for purposes of explanation, used specific nomenclature to provide a thorough understanding of the described embodiments. However, it will be apparent to one skilled in the art that the specific details are not required in order to practice the described embodiments. Thus, the foregoing descriptions of the specific embodiments described herein are presented for purposes of illustration and description. They are not targeted to be exhaustive or to limit the embodiments to the precise forms disclosed. It will be apparent to one of ordinary skill in the art that many modifications and variations are possible in view of the above teachings.

What is claimed is:

1. A method for forming a magnet having multiple magnetic zones in a single monolithic substrate, the method comprising:

applying a first magnetic field to the single monolithic substrate to impart a first magnetic polarity to the single monolithic substrate;

aligning first regions of the single monolithic substrate with heating elements, the first regions separated by intervening second regions;

causing the heating elements to heat the first regions of the single monolithic substrate, wherein a coercivity of the first regions that are heated is reduced from a first coercivity to a second coercivity; and applying a second magnetic field to the single monolithic substrate, thereby imparting a second magnetic polarity to the first regions, the second magnetic polarity opposite the first magnetic polarity, wherein the second regions retain the first magnetic polarity.

2. The method of claim 1, wherein subsequent to heating the first regions, the method further comprises:

aligning the first regions with magnetic field concentration zones of a fixture, wherein applying the second magnetic field includes causing the magnetic field concentration zones to apply the second magnetic field locally to the first regions.

3. The method of claim 2, wherein the magnetic field concentration zones correspond to extending members of the fixture.

4. The method of claim 1, wherein the first magnetic field is stronger than the second magnetic field.

5. The method of claim 1, wherein the first magnetic field has a strength of at least 5 kilogauss.

6. The method of claim 1, further comprising aligning shunts with the second regions of the single monolithic substrate prior to applying the second magnetic field.

7. The method of claim 6, the shunts are composed of iron.

8. The method of claim 1, wherein the heating elements are lasers or inductive heating elements.

9. The method of claim 1, wherein the single monolithic substrate has a thickness of between about 0.4 and 2.2 millimeters.

10. A method for forming a magnet having multiple magnetic zones in a single monolithic substrate, the single monolithic substrate having a first magnetic polarity, the method comprising:

heating the single monolithic substrate to change a coercivity of the single monolithic substrate from a first coercivity to a second coercivity less than the first coercivity;

aligning first regions of the single monolithic substrate with magnetic field concentration zones of a fixture, the first regions separated by intervening second regions of the single monolithic substrate; and causing the magnetic field concentration zones to apply a magnetic field to the first regions, thereby imparting a second magnetic polarity to the first regions, the second magnetic polarity opposite the first magnetic polarity, wherein the second regions retain the first magnetic polarity.

11. The method of claim 10, wherein an entirety of the single monolithic substrate is heated.

12. The method of claim 11, wherein only the first regions of the single monolithic substrate are sufficiently heated to the second coercivity.

13. The method of claim 12, wherein the first regions are heated using multiple heating elements.

14. The method of claim 10, wherein the magnetic field concentration zones correspond to extending members of the fixture.

15. The method of claim 14, further comprising aligning shunts with the second regions of the single monolithic substrate prior to applying the magnetic field.

16. The method of claim 10, wherein the fixture is in contact with the single monolithic substrate when the magnetic field is applied.

17. The method of claim 10, wherein the fixture is a permanent magnet.

18. A magnet, comprising:

a single monolithic substrate composed of ferromagnetic metal, the single monolithic substrate including:

a first magnetic region characterized as having a first induced magnetic field polarity strength corresponding to a first coercivity at a first temperature; and a transition zone located between the first magnetic region and a second magnetic region of the single monolithic substrate, wherein the second magnetic region is characterized as having a second induced magnetic field polarity that is opposite of the first induced magnetic field polarity, and the transition zone is characterized as being un-magnetized in accordance with a coercivity at a nominal temperature that is less than the first temperature.

19. The magnet of claim 18, wherein the first induced magnetic field polarity is caused by:

applying a first magnetic field to the single monolithic substrate to impart the first induced magnetic field polarity to the first magnetic region while the first magnetic region is heated by heating elements.

20. The magnet of claim 18, wherein the second magnetic region is characterized as having a second induced magnetic field polarity corresponding to a second coercivity at a second temperature.

* * * * *